US005393441A

United States Patent [19]

Thaler et al.

[11] Patent Number: 5,393,441

[45] Date of Patent: Feb. 28, 1995

[54] TWO-CYCLE OIL ADDITIVE

[75] Inventors: Warren A. Thaler, Flemington; Stephen Zushma; Richard H. Schlosberg, both of Clinton, all of N.J.

[73] Assignee: Exxon Research and Engineering Company, Florham Park, N.J.

[21] Appl. No.: 156,505

[22] Filed: Nov. 23, 1993

[51] Int. Cl.[6] ..... C10M 133/56

[52] U.S. Cl. ..... 252/51.5 A; 564/204; 564/511; 564/512; 549/233; 548/546

[58] Field of Search ..... 564/204, 511, 512; 549/233; 548/546; 252/51.5 A; C10M 133/16, 133/38, 133/44, 133/48, 133/04, 133/16

[56] References Cited

U.S. PATENT DOCUMENTS 4,956,107 9/1990 Gutierrez et al. ..... 252/47

5,229,020 7/1993 Gutierrez et al. ..... 252/51.5 A

*Primary Examiner*—Prince Willis, Jr.

*Assistant Examiner*—Cephia D. Toomer

*Attorney, Agent, or Firm*—Joseph J. Dvorak

[57] ABSTRACT

Briefly stated, the present invention comprises novel compounds useful as two-cycle oil additives obtained by reacting an alkyl acrylamide with a compound selected from the group consisting of polyalkylenepolyamines, polyalkylenepolyamines functionalized with polyalkyl acid anhydrides and polyalkylenepolyamines and a polyalkyl acid anhydride.

8 Claims, No Drawings

TWO-CYCLE OIL ADDITIVE

FIELD OF THE INVENTION

The invention relates to novel compounds suitable as two-cycle oil additives, concentrates and compositions containing such additives.

BACKGROUND OF THE INVENTION

Two-cycle internal combustion engines are lubricated by mixing a two-cycle engine oil in a prescribed proportion with fuel for the engine. The mixture of fuel and lubricant passes through the crank case of a two-cycle engine where it lubricates the moving parts of the engine and then flows through the intake ports of the engine into the combustion chamber where the fuel and lubricant is burned. Thus a lubricant used in a two-cycle internal combustion engine must not only provide for adequate lubrication of moving engine parts but it must also be able to burn cleanly without leaving objectionable engine deposits, or the like.

There are many different two-cycle engines oil additives. However, because of the increasing severity of the conditions under which two-cycle engines now operate, there is a demand for new and improved additives for two-cycle engines.

It is therefore an object of the present invention to provide a new and improved two-cycle engine oil additive.

SUMMARY OF THE INVENTION

Briefly stated, the present invention comprises novel compounds useful as two-cycle oil additives obtained by reacting an alkyl acrylamide with a compound selected from the group consisting of polyalkylenepolyamines, polyalkylenepolyamines functionalized with polyalkyl acid anhydrides and polyalkylenepolyamines and a polyalkyl acid anhydride.

In another embodiment of the present invention, there is provided a two-cycle oil composition comprising a major portion of a two-cycle oil and a minor portion of an additive comprising the reaction product of an alkyl acrylamide, a polyalkylenepolyamine and a polyalkyl acid anhydrides.

DETAIL DESCRIPTION OF THE INVENTION

The invention is directed toward novel compounds useful as two-cycle oil additives obtainable by chemically combining (1) an alkyl acrylamide and a polyalklenepolyamine, (2) an alkyl acrylamide and a polyalkylene polyamine functionalized with a polyalkyl acid anhydride, or (3) a polyalkylenepolyamine and a polyalkylacid anhydride. The invention encompasses concentrates and two-cycle oil compositions containing such additives.

The alkyl acrylamide used forming in compounds of the present can be represented by the following general formula

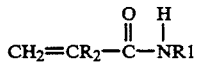

wherein R1 is an alkyl group aving from about 12 to 24 carbon atoms and preferably between about 16 to 18 carbon atoms, and $R_2$ is H or a $C_1$ to $C_3$ alkyl group and preferably $C_1$. Compounds having the foregoing formula are readily prepared by reacting a nitrile with an olefin in the presence of an acid catalyst, such as sulfuric acid.

In one embodiment of the present invention, the alkyl acrylamide is reacted with a polyalkylenepolyamine to form a novel compound. The polyalkylenepolyamine useful as a reactant may generally be characterized by the formula

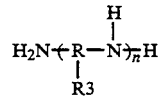

wherein R is a $C_2$ or $C_3$ alkylene radical or mixtures thereof, and R3 is hydrogen or an alkyl radical up from about 1 to about 16 carbon atoms, and n is an integer greater than 1. Preferably n is an integer less than about 6 and the alkylene group R is ethylene or propylene. Particularly preferred polyamines in the practice of the present invention include diethylenetriamine; triethylenetetramine and tetraethylene pentamine.

The alkyl acrylamide and the polyamine are combined and the mole ratio of about 1:1 to 1:3 in the presence of a catalyst, such as acetic acid for a time and at a temperature sufficient for the polyamine to react with the alkyl acrylamide. Typical temperatures range from about 60° C. to 180° C. and typical reaction times run from about 1 to 8 hours. The amidoamine product formed by the reaction of the acrylamide and polyamine is useful as a dispersant. It is also useful in forming an oil additive of the present invention by combining the amidoamine with a polyalkyl acid anhydride, such as polyisobutenyl succinic anhydride. Typically the amidoamine and polyalkyl acid anhydride will be combined in a mole ratio of about 10:1 to 4:1 for a time and at a temperature sufficient to cause the anhydride and amidoamine to react. Typical times run from about 1 to 8 hours at temperatures from about 40° C. to 180° C. The resultant product is useful as a two-cycle oil additive.

In yet another embodiment of the present invention, an alkyl acrylamide, as previously defined, may be chemically combined with a polyalkylenepolyamine of the foregoing type which has been first functionalized with a polyalkyl acid anhydride, such as polyisobutenyl succinic anhydride. The ratio of reagents, reaction time and temperature are the same as if the polyamine were not functionalized.

The additives of the present invention can be incorporated into a lubricating oil in any convenient way. Thus, the compounds, or mixtures thereof, can be added directly to the oil at the desired level or by adding concentrates of the additives to the oil. Accordingly, the additive can be blended with a suitable oil soluble solvent such as mineral spirits and/or base oil to form a concentrate and then the concentrate may be blended with lubricating oil to obtain a final formulation. Such dispersant concentrates typically contain on an active ingredient basis from about 10 wt % to 95 wt % and preferably from about 20 wt % to about 70 wt % additive and typically from about 0 wt % to about 95 wt % and preferably from about 5 wt % to about 80 wt % base oil, based on the weight of concentrate. The concentrate can also comprise from 0 wt % to 80 wt % typically from 10 wt % to 60 wt % solvent.

Compositions comprised of a major amount of two-cycle oil and a minor amount of the additive is within the scope of the present invention. The additive typically will be present in the two-cycle oil at a level up from about 3% to about 20% by volume of the composition and preferably from about 7% to 15% by volume of the composition.

This invention is more fully delineated in the examples which follow.

EXAMPLE 1

Octadecylacrylamide was reacted with diethylenetriamine to produce an amidoamine in the following manner. Diethylenetriamine (1.16 g, 0.11 mole), octadecylacrylamide (10.0 g, 0.031 mole) and acetic acid (0.1057 g, 0.0018 mole) were combined and heated 120° C. with stirring for 3 hours. $_{13}$CNMR showed that the vinyl carbons of the acrylamide were no longer present indicating complete reaction.

EXAMPLE 2

Polyisobutenyl succinic anhydride (2.86 g, 0.0028 mole), with a polyisobutenyl number average molecular weight of about 1000 was added to the amidoamine prepared in Example 1 and the mixture was heated for an additional 3 hours to form a novel oil additive of the present invention.

EXAMPLE 3

Octadecylacrylamide (10.0 g, 0.031 mole) was added to diethyltriamine (1.16 g, 0.11 mole) and polyisobutenyl succinic anhydrides (2.86 g, 0.0028 mole) which had been previously heated at 120° C. for one hour. Acetic acid (0.1057 g, 0.0018 mole) was added and the mixture heated for three hours at 120° C. to form an additive of the present invention.

EXAMPLES 4 to 19

In these examples, 10% solutions of the additives made by procedures outlined herein were prepared in heptane, polyalphaolefin (PAO) and CWO oil and stored at 5° C. After long term standing, these samples remained in solution with the results shown in Table I (B - See Attached).

EXAMPLES 20, 21 and Comparative Example 22

Two products were evaluated for detergency in a 4cSt+PAO oil using a panel coker test procedure. In Example 20 the additive was prepared via the method of Example 2. In Example 21 the additive was prepared by the method of Example 3. For comparative purposes, a coker test was conducted on the oil without any additive i.e. no active ingredient. The results were good as shown in the accompanying Table 2.

TABLE 1

| | Additive | | | |
|---|---|---|---|---|
| | Solubility at 5 DEG*C | | | |
| Example | Heptane | 4cSt PAO | CWO | Comments |
| 4 | Cloudy | Cloudy | Cloudy | Mode A |
| 5 | Cloudy | Cloudy | Cloudy | Mode B |
| 6 | Cloudy | Cloudy | Cloudy | Mode A |
| 7 | Cloudy | Cloudy | Cloudy | Mode B |
| 8 | Cloudy | | | Mode A |
| 9 | Cloudy | | | Mode B |
| 10 | Clear | Clear | Clear | Mode A |
| 11 | Sl Cloudy | | | Mode B |
| 12 | Clear | Sl Cloudy | Clear | Mode A |
| 13 | Sl Cloudy | Cloudy | Sl Cloudy | Mode A |
| 14 | | Sl Cloudy | Clear | Mode A |
| 15 | | Sl Cloudy | Clear | Mode A |
| 16 | | Cloudy | Clear | Mode A |

TABLE 1-continued

| | Additive | | | |
|---|---|---|---|---|
| | Solubility at 5 DEG*C | | | |
| Example | Heptane | 4cSt PAO | CWO | Comments |
| 17 | | Cloudy | Clear | Mode B |
| 18 | | Clear | Clear | Mode A |
| 19 | | Clear | Clear | Mode B |

NOTES:
Mode A: The Example 2 preparative procedure was used in making the addition.
Mode B: The Example 3 preparation was used.

TABLE 2

| | Detergency Tests | | |
|---|---|---|---|
| | Comparative Ex. 22 | Example 20 | Example 21 |
| Panel Coker Test | | | |
| % additive treat | 0 | 10.0 | 10.0 |
| Panel Deposit, mg | | | |
| PAO Batch #1 | 12 | — | — |
| PAO Batch #2 | 43 | 8 | 9 |

What is claimed is:

1. A two-cycle oil composition comprising a major portion of a two cycle oil and a minor amount of an additive obtained by reacting an acrylamide with a compound selected from the group consisting of a polyalkylene polyamine, a polyalkylene acid anhydride, and mixtures thereof, wherein the acrylamide has the formula:

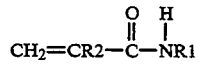

wherein R1 is an alkyl group having from 12 to 24 carbon atoms and R2 is H or a $C_1$ to $C_3$ alkyl group.

2. The composition of claim 1 wherein the polyalkylenepolyamine has the formula

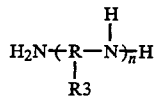

wherein R is a $C_2$ or $C_3$ alkylene radical or mixtures thereof, R3 is hydrogen or an alkyl radical of from 1 to to 16 carbon atoms and n is an integer of from 1 to 6.

3. The composition of claim 2 wherein the polyalkylene acid anhydride is polyisobutenyl succinic anhydride.

4. A compound obtained by reacting acrylamide with a reagent selected from the group consisting of polyalkylene polyamine functionalized with a polyalkylene acid anhydride; and a mixture of a polyalkylenepolyamine and a polyalkylene acid anhydride, wherein the acrylamide has the formula:

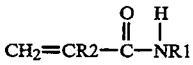

5. The compound of claim 5 wherein the polyamine is functionalized with a polyalkylene acid anhydride.

6. The compound of claim 4 wherein the acrylamide is reacted with a mixture of a polyalkylenepolyamine and a polyalkylene acid anhydride.

7. The compound of claim 6 wherein the polyalkylene acid anhydride is polybutenyl succinic anhydride.

8. A two-cycle additive concentrate containing from about 5 wt % to about 80 wt % of a solvent and from about 10 wt % to about 95 wt % of a compound obtained by reacting acrylamide with a reagent selected from the group consisting of polyalkylene polyamines; polyakylenepolyamine functionalized with a polyalkylene acid anhydride; and a mixture of a polyalkylene-polyamine and a polyalkylene acid anhydride, wherein the acrylamide is the formula $$CH_2{=}CR2{-}\overset{\overset{\displaystyle O}{\|}}{C}{-}\overset{\overset{\displaystyle H}{|}}{N}R1$$

wherein R1 is an alkyl group havinq from 12 to 24 carbon atoms and R2 is H or a $C_1$ to $C_3$ alkyl group.

* * * * *